US012384571B2

(12) United States Patent
Chen et al.

(10) Patent No.: US 12,384,571 B2
(45) Date of Patent: Aug. 12, 2025

(54) ATOMIZER OIL FILLING EQUIPMENT AND METHOD

(71) Applicant: SHENZHEN IMPETUS TECHNOLOGY CO, LTD, Shenzhen (CN)

(72) Inventors: Liqian Chen, Shenzhen (CN); Ming Zhang, Shenzhen (CN)

(73) Assignee: SHENZHEN IMPETUS TECHNOLOGY CO, LTD, Shenzhen (CN)

( * ) Notice: Subject to any disclaimer, the term of this patent is extended or adjusted under 35 U.S.C. 154(b) by 244 days.

(21) Appl. No.: 18/320,160

(22) Filed: May 18, 2023

(65) Prior Publication Data

US 2024/0383626 A1 Nov. 21, 2024

(51) Int. Cl.

| | |
|---|---|
| ***A24F 40/70*** | (2020.01) |
| ***B65B 3/04*** | (2006.01) |
| *A24F 40/10* | (2020.01) |
| *A24F 40/42* | (2020.01) |
| *A24F 40/485* | (2020.01) |

(52) U.S. Cl.

CPC ..... *B65B 3/04* (2013.01); *A24F 40/70* (2020.01); *A24F 40/10* (2020.01); *A24F 40/42* (2020.01); *A24F 40/485* (2020.01)

(58) Field of Classification Search

CPC ..... A24F 40/70; B65B 3/04

See application file for complete search history.

(56) References Cited

U.S. PATENT DOCUMENTS

| | | | | |
|---|---|---|---|---|
| 9,956,656 | B2 * | 5/2018 | Zou | B23P 19/02 |
| 10,407,196 | B2 * | 9/2019 | Slurink | B65B 3/003 |
| 11,744,294 | B2 * | 9/2023 | Kwon | A24F 15/01 131/328 |
| 11,891,206 | B2 * | 2/2024 | Testoni | B65B 65/006 |
| 12,157,594 | B2 * | 12/2024 | Zaniboni | B65B 43/52 |
| 2018/0126066 | A1 * | 5/2018 | Narvekar | A61J 1/1412 |
| 2023/0063630 | A1 * | 3/2023 | Testoni | B65B 3/28 |
| 2023/0113542 | A1 * | 4/2023 | Testoni | B65B 3/04 131/328 |

FOREIGN PATENT DOCUMENTS

| | | | | |
|---|---|---|---|---|
| CN | 105752911 B | * | 3/2024 | B67C 3/007 |

* cited by examiner

*Primary Examiner* — Nicolas A Arnett

(74) *Attorney, Agent, or Firm* — Andrew C. Cheng

(57) ABSTRACT

An atomizer oil filling equipment provided includes an atomizer oil filling tool, a supporting plate, and an oil filling device. The atomizer oil filling tool is configured to load a plurality of atomizers with oil filling openings facing downward, a bottom of the atomizer oil filling tool defines first oil filling holes corresponding to the oil filling openings respectively. The supporting plate is configured to support the atomizer oil filling tool, and the supporting plate defines second oil filling holes corresponding to the first oil filling holes respectively; the oil filling device is movably installed on one side of the supporting plate away from the atomizer oil filling tool, the oil filling device has an oil filling needle, and the oil filling device fills the oil into the atomizers by the oil filling needle.

2 Claims, 6 Drawing Sheets

ATOMIZER OIL FILLING EQUIPMENT AND METHOD

TECHNICAL FIELD

The disclosure relates to atomizers of electronic cigarettes technologies, in particular to oil filling equipment and method for an atomizer.

BACKGROUND

Nowadays, electronic cigarettes are popular, many smokers like to smoke with electronic cigarettes, and the electronic cigarettes generally have two types. One type of the electronic cigarettes are to burn tobacco-liquid the other type of the electronic cigarette are to burn the tobacco leaves. Each electronic cigarette burning the tobacco-liquid needs to fill the tobacco liquid into the atomize, and then the atomizer filled with the tobacco liquid is installed into the electronic cigarette and be heated.

An existing oil filling method for atomizers is generally to put every atomizer into an oil filling equipment to fill oil. into the atomizers. As a result, the existing oil filling method is low efficient and high labor cost.

In addition, the existing oil filling method is generally to fill oil from top to bottom, which may cause foreign matters or dander to enter into the atomizer during the oil filling.

SUMMARY

At a first aspect, an atomizer oil filling equipment is provided. The atomizer oil filling equipment includes an atomizer oil filling tool, a supporting plate, and an oil filling device. The atomizer oil filling tool is configured to load a plurality of atomizers with oil filling openings facing downward, a bottom of the atomizer oil filling tool defines first oil filling holes corresponding to the oil filling openings respectively. The supporting plate is configured to support the atomizer oil filling tool, and the supporting plate defines second oil filling holes corresponding to the first oil filling holes respectively; the oil filling device is movably installed on one side of the supporting plate away from the atomizer oil filling tool, the oil filling device has an oil filling needle, and the oil filling device fills the oil into the atomizers by the oil filling needle.

At a second aspect, an atomizer oil filling equipment is provided. The atomizer oil filling equipment includes an atomizer oil filling tool, a supporting plate, and an oil filling device. The atomizer oil filling tool is configured to load a plurality of atomizers with oil filling openings, one side of the atomizer oil filling tool facing to the oil filling opening defines first oil filling holes corresponding to the oil filling openings respectively. The supporting plate is under the atomizer oil filling tool and faces to the oil filling opening through the first oil filling holes, the supporting plate is configured to support the atomizer oil filling tool with the plurality of the atomizers, and the supporting plate defines second oil filling holes corresponding to the first oil filling holes respectively. The oil filling device is movably installed on one side of the supporting plate away from the atomizer oil filling tool, the oil filling device having an oil filling needle, and the oil filling device filling the oil into the atomizers by the oil filling needle.

At a third aspect, an oil filling method is provided. The oil filling method includes steps of taking out an atomizer module loaded with a plurality of atomizers from the atomizer packaging box; installing the atomizer module into the atomizer oil filling tool with the atomizer oil filling opening facing down; loading the atomizer oil filling tool equipped with the atomizer module into the atomizer oil filling equipment; and piercing the oil filling opening of each atomizer sequentially via the oil filling needle of the atomizer oil filling equipment from bottom to top and simultaneously filling tobacco-liquid into the atomizer.

BRIEF DESCRIPTION OF THE DRAWINGS

In order to more clearly illustrate the technical solutions in the embodiments of the disclosure, the following will briefly introduce the accompanying drawings that need to be used in the descriptions of the embodiments or the prior art. Obviously, the accompanying drawings in the following description are only of the disclosure. For some embodiments, those of ordinary skill in the art can also obtain other drawings based on these drawings without paying creative efforts.

REFERENCE NUMBER IN THE DRAWING

Figure 1:
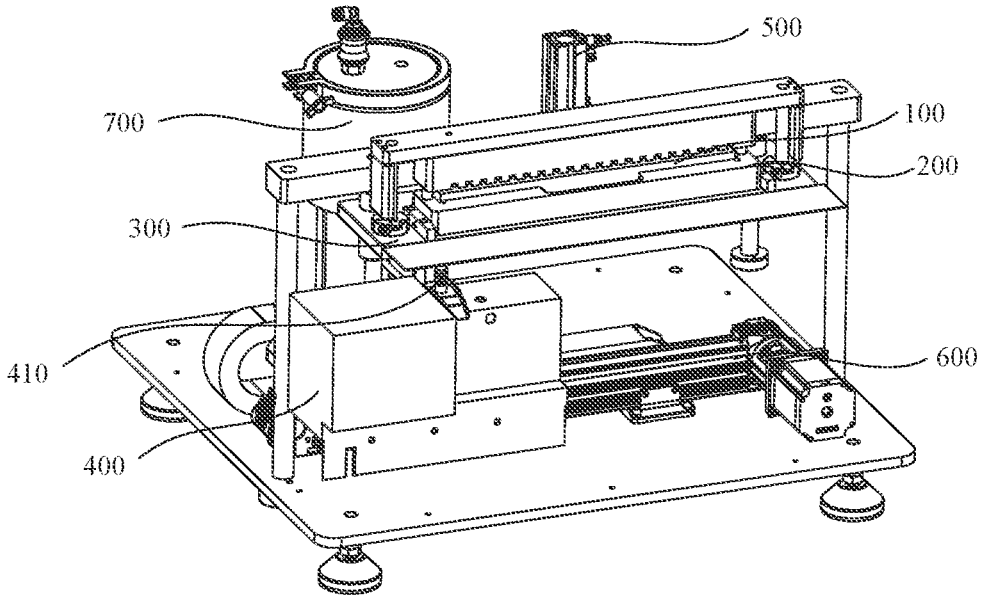
FIG. 1 is the structural diagram of the atomizer oiling equipment equipped with the atomizer oil filling tool provided by the disclosure.

100, atomizer module; 110, atomizer receiving part; 120, atomizer; 200, atomizer oil filling tool; 210, upper seat; 211, second positioning groove; 212, guiding groove; 220, the lower seat; 221, the first oil filling hole; 222, limit groove; 223, escape groove; 224, buffer groove; 225, first positioning groove; 230, guiding column; 240, receiving space; 300, supporting plate; 310, second oil filling hole; 320, first limiting structure; 321, first limit block; 322, second limit block; 330, second limiting structure; 400, oil filling device; 410, oil filling needle; 411, body; 412, needling part; 413, mounting part; 414, oil filling hole; 500, first driving structure; 510, lifting cylinder; 520, base; 530, bracket; 540, guiding shaft; 600, second driving structures; 700, oil filling barrel; 710, oil filling pipe.

DETAILED DESCRIPTION OF THE EMBODIMENTS

In order to make the technical problems, technical solutions and beneficial effects to be solved by the disclosure clearer, the disclosure will be further described in detail below in conjunction with the accompanying drawings and embodiments. It should be understood that the specific embodiments described here are only used to explain the disclosure, not to limit the disclosure.

It should be noted that when an element is referred to as being "fixed" or "disposed on" another element, it may be directly on the other element or be indirectly on the other element. When an element is referred to as being "connected to" another element, it can be directly connected to the other element or indirectly connected to the other element.

It is to be understood that the terms "length", "width", "top", "bottom", "front", "rear", "left", "right", "vertical", "horizontal", "top", "bottom", "inner", "outer" and other indicated orientations or positional relationships are based on the orientations or positional relationships shown in the drawings, and are only for the convenience of describing the disclosure and simplifying the description, rather than indicating or implying the referred device Or elements must have a certain orientation, be constructed and operate in a certain orientation, and thus should not be construed as limiting the invention.

In addition, the terms "first" and "second" are used for descriptive purposes only, and cannot be interpreted as indicating or implying relative importance or implicitly specifying the quantity of indicated technical features. Thus, a feature defined as "first" and "second" may explicitly or implicitly include one or more of these features. In the description of some inventions, "plurality" means two or more, unless otherwise specifically defined.

Referring to FIG. 1, an atomizer oil filling equipment is provided to simultaneously fill oil into a plurality of atomizers 120 from bottom to top, and improve filling efficiency, and prevent foreign matters or dander from entering into the atomizers 120 during filling oil.

Figure 2:
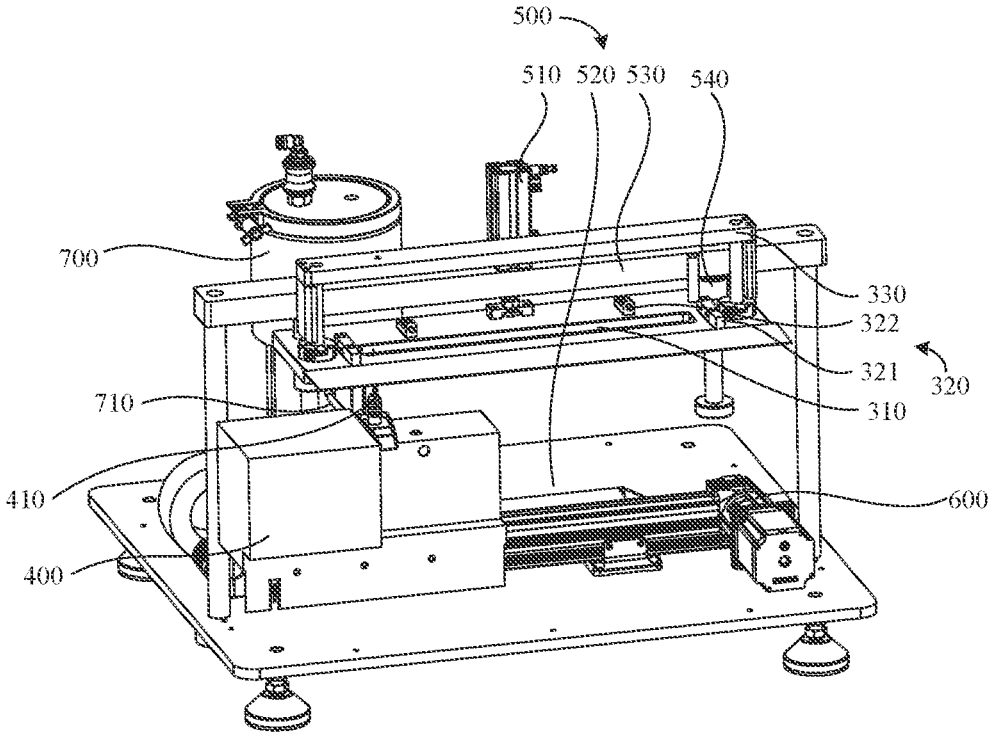
FIG. 2 is the structure of the atomizer oiling equipment provided by the disclosure without carrying the atomizer oil filling tool Figure.

Referring to FIG. 1 and FIG. 2, the atomizer oil filling equipment includes a supporting plate 300, an atomizer oil filling tool 200, and an oil filling device 400. A plurality of atomizers 120 with the oil filling openings facing down are loaded on the atomizer oil filling tool 200, and first oil filling holes 221 corresponds to the oil filling openings are defined on the bottom of the atomizer oil filling tool 200. The atomizer oil filling tool 200 is loaded on the supporting plate 300, and second oil filling holes 310 are defined on the supporting plate 300 corresponding to the first oil filling hole 221. The oil filling device 400 is moveably mounted to one end of the supporting plate 300 away from the atomizer oil filling tool 200. An oil filling needle 410 is located at an outlet of the oil filling device 400, and the oil filling device 400 fills oil into the atomizer 120 via the oil filling needle 410.

In actual use, first, the plurality of the atomizers 120 with the oil filling openings facing down are first installed on the atomizer oil filling tool 200 at the same intervals; then, the atomizer oil filling tool 200 with atomizers 120 are installed on the supporting plate 300, and the first oil filling holes 221 on the atomizer oil filling tool 200 are aligned with the second oil filling holes 310 on the supporting plate 300; finally the oil filling needle 410 pass through a group of the second oil filling hole 310, the first oil filling hole 221, and the oil filling opening orderly, and the oil filling device 400 fills oil into the atomizer 120 via the oil filling needle 410.

It can be seen that in the atomizer oiling equipment described above, the plurality of the atomizers 120 with the oil filling opening facing down are capable of being installed in the the atomizer oil filling tool 200 at the same intervals, and the oil filling device 400 is movably arranged on the one end of the the supporting plate 300 far away from the atomizer oil filling tool 200, and filling oil into each atomizer 120 via the oil filling needle 410, so as to realize oil filling for the plurality of the atomizers 120 from bottom to top, improve the filling efficiency and at the same time prevent foreign matters or dander from entering into each atomizer 120 during filling.

Referring to FIG. 2, further, a first limiting structure 320 is set on the supporting plate 300, and when the atomizer oil filling tool 200 is loaded on the supporting plate 300, the first limiting structure 320 controls the atomizer oil filling tool 200 to be limited in a horizontal direction, so that each first oil filling hole 221 of the atomizer oil filling tool 200 is aligned with each second oil filling hole 310 correspondingly on the supporting plate 300.

In detail, the first limiting structure 320 includes two opposite first limiting block 321 arranged along a length direction of the atomizer oil filling tool 200, and at least one second limiting block 322 arranged along a width direction of the atomizer oil filling tool 200, the first limiting block 321 and the second limiting block 322 form a limiting area in the horizontal direction. When the atomizer oil filling tool 200 is loaded on the supporting plate 300, the atomizer oil filling tool 200 is just located on the limit area, so that the first oil filling hole 221 of the atomizer oil filling tool 200 is aligned with the second oil filling hole 310 of the supporting plate 300.

Further, a second limiting structure 330 is disposed on the supporting plate 300. When the atomizer oil filling tool 200 is loaded on the supporting plate 300, the second limiting structure 330 limits the atomizer oil filling tool 200 in the vertical direction so that the oil filling needle 410 can be inserted into the oil filling opening of the atomizer 120.

In detail, the second limiting structure 330 include a baffle disposed above the supporting plate 300, and a limiting area is formed between the baffle and the supporting plate 300 in the vertical direction. When the atomizer oil filling tool 200 is loaded on the supporting plate 300, the baffle plate and the supporting plate 300 limit the atomizer oil filling tool 200 in the limit area, that it prevents the atomizer oil filling tool 200 moving during the oil filling needle 410 is being inserted into the oil filling opening of the atomizer 120.

It can be understood that, the method of filling the atomizer 120 from bottom to top, the oil filling needle 410 needs to penetrate silica gel sealing the oil filling opening of the atomizer 120, therefore, the atomizer oil filling tool 200 is required to be fixed during the oil filling needle 410 is penetrating the silica gel and it ensures the silica gel .is penetrated.

Referring to FIG. 2, the atomizer oil filling equipment further includes a first driving structure 500. The first driving structure 500 is connected with the supporting plate 300, and is configured to drive the supporting plate 300 to take the atomizer to move toward the oil filling needle 410, so that the oil filling needle 410 can be inserted into the oil filling opening of the atomizer 120.

In detail, when the atomizer oil filling tool 200 is loaded on the supporting plate 300, the first driving structure 500 drives the supporting plate 300 to take the atomizer oil filling tool 200 and the atomizer loaded on the atomizer oil filling tool 200 to move toward the oil filling needle 410 so that the oil filling needle 410 can pass through the second oil filling hole 310, the first oil filling hole 221, and the silica gel sealing on the oil filling opening in order to filling oil into the atomizer 120.

In this embodiment, the first driving structure 500 can be a lifting cylinder 510, and the atomizer oil filling equipment can also include a base 520, and the lifting cylinder 510 is disposed on the base 520 via a bracket 530, a guiding shaft 540 is connected between the supporting plate 300 and the bracket 530, The first driving structure 500 drives the supporting plate 300 to move relative to the bracket 530 along the guiding shaft 540, so that the supporting plate 300 moves toward the oil filling needle 410.

Referring to FIG. 2, the atomizer oil filling equipment further includes a second driving structure 600. The second driving structure 600 is connected with the oil filling device 400, and is configured to drive the oil filling device 400 and the oil filling needle 410 of the oil filling device 400 to move along a direction of loading the atomizers 120 on the atomizer oil filling tool 200, so that the oil filling needle 410 can filling oil to each atomizer 120.

For example, in this application, when the atomizer 120 is evenly loaded on the atomizer oil filling tool 200 along the length direction of the atomizer oil filling tool 200, the second driving structure 600 drives the oil filling device 400 and the oil filling device 400 is set The oil filling needle 410 moves along the length direction of the atomizer oil filling tool 200.

In the disclosure, the second driving structure 600 may be a linear motor or a screw motor.

In addition, the atomizer oil filling equipment also includes an oil filling barrel 700 for storing tobacco-liquid. The oil filling barrel 700 is connected with the oil filling device 400 via the oil filling pipe 710, and is configured to supply oil to the oil filling device 400, so that the oil filling device 400 can filling the tobacco-liquid into the atomizer 120 via the oil filling needle 410.

Figure 3:
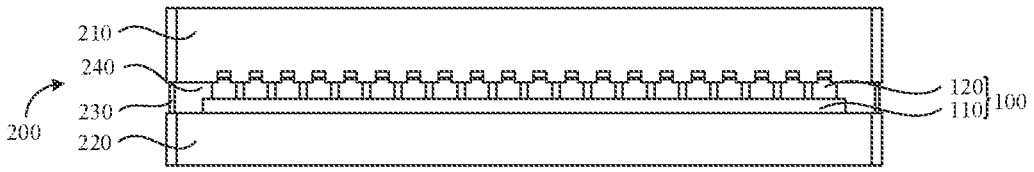
FIG. 3 is a structural diagram of the atomizer oil filling tool equipped with an atomizer module provided by the disclosure.

Referring to FIG. 3, an atomizer oil filling tool 200 is also provided to load the atomizer module 100, so as to put the atomizer module 100 into the atomizer oiling equipment, to fill the atomizer module 100 with the oil.

In detail, the atomizer module 100 includes an atomizer receiving part 110, and the plurality of atomizers 120 to be filled with the oil are placed on the atomizer receiving part 110 at the same intervals, and the atomizers 120 can be exposed in a manner of the oil filling opening facing down. For example, a plurality of receiving holes are defined on the atomizer receiving part 110 at the same intervals along the length direction of the atomizer receiving part 110, and each receiving hole can received one atomizer 120 to be filled with the oil.

Figure 4:
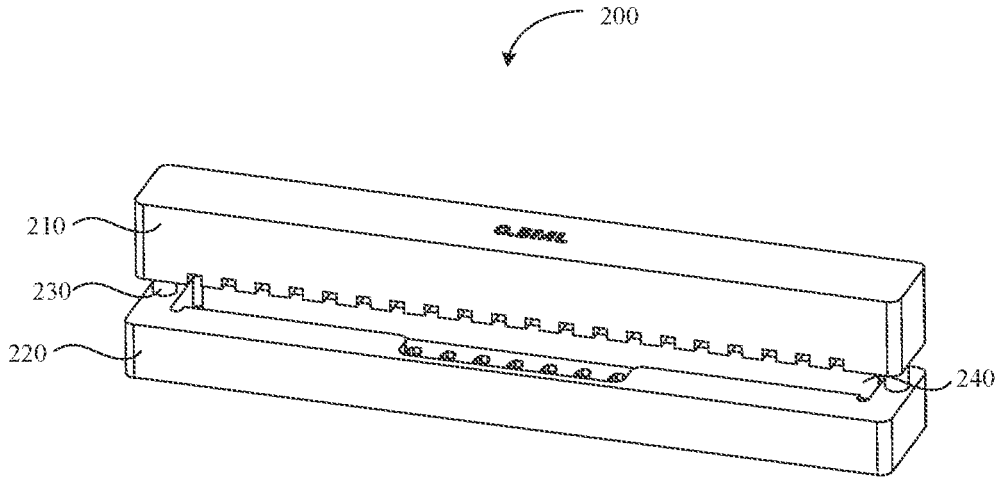
FIG. 4 is a structural diagram of the atomizer oil filling tool provided by the disclosure.

Referring to FIG. 3 and FIG. 4, an atomizer oil filling tool 200 includes an upper seat 210 and a lower seat 220. The upper seat 210 is detachably arranged on the lower seat 220 along the vertical direction, and a receiving space 240 is defined between the upper seat 210 and the lower seat 220 to received the atomizer receiving part 110.

In detail, when the atomizer receiving part 110 is located in the receiving space 240, the upper seat 210 and the lower seat 220 fix the atomizer receiving part 110.

Figure 5:
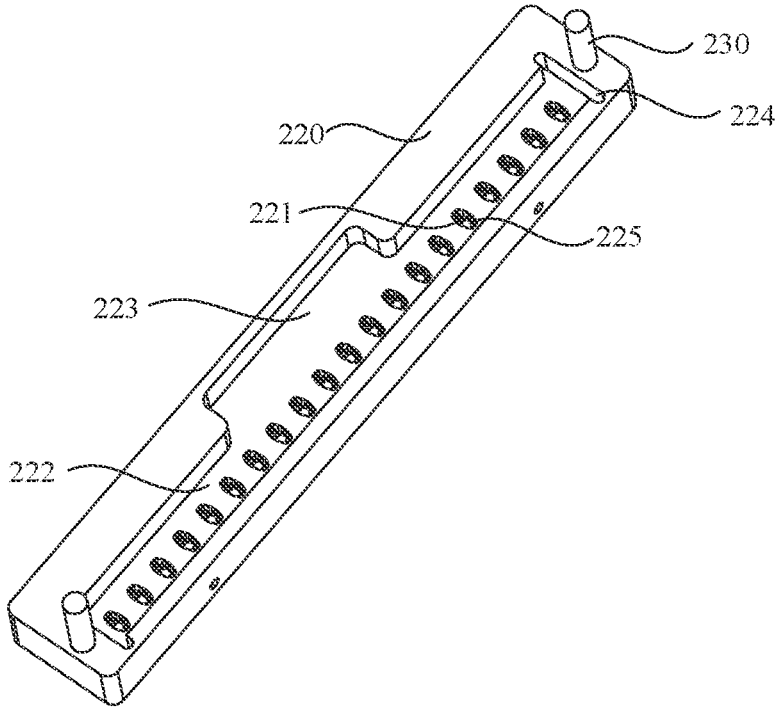
FIG. 5 is provided by the disclosure.

Further, referring to FIG. 5, first oil filling holes 221 are defined on the lower seat 220 corresponding to the oil filling opening of each atomizer 120 received in the atomizer receiving part 110.

In detail, when the atomizer module 100 is loaded into the atomizer oil filling tool 200, the atomizer receiving part 110 is located in the receiving space 240, and the oil filling opening of each atomizer 120 in the atomizer receiving part 110 just aligns with each first oil filing hole 221.

In actual use, disassembling the upper seat 210 and the lower base 220; installing the atomizer module 100 with the oil filling opening of the atomizer 120 facing down on the lower base 220, and making each atomizer 120 align the oil filling opening with the corresponding first oil filling hole 221; then installing the upper seat 210 on the lower seat 220, and the upper seat 210 and the lower seat 220 match the atomizer module 100 to fix the atomizer receiving part 110, that the loading the atomizer module 100 by the atomizer oil filling tool 200 is finished; putting the atomizer oil filling tool 200 loaded with the atomizer module 100 into the atomizer oiling filling equipment to fill with the oil.

It can be understood that after the upstream manufacturer produce the atomizers 120, in order to facilitate the packaging and transportation of the atomizers 120, it is generally used to pack the plurality of atomizers 120 into the atomizer module 100 through the atomizer receiving part 110. Therefore, the atomizer oil filling tool 200 can directly install the entire atomizer module 100, which can reduce the time to put the atomizers 120 into the atomizer oil filling tool 200 because there is no need to take out the atomizers 120 from the atomizer receiving part 110 one by one. and the atomizer oiling equipment is enabled to fill the plurality of the atomizers 120 with the oil.

In addition, the first oil filling hole 221 of the atomizer oil filling tool 200 is arranged on the lower seat 220, so that the atomizer 120 can be filled with the oil from bottom to top, it prevents foreign matters or dander from entering into into the atomizer 120 during filed with the oil. It should be noted that, the detail oil filling method from bottom to top can refer to the drip bottle, which inserts the oil filling needle 410 into an object made of silicone and seal the oil filling opening.

It can be seen that the atomizer oil filling tool 200 is provided with the upper seat 210 and the lower seat 220 both being detachable, and the receiving space 240 is defined between the upper seat 210 and the lower seat 220 to receive the atomizer receiving part 110, and the entire atomizer module 100 can be loaded into the atomizer oil filling tool 200 to improve the filling efficiency. In addition, there is also provided with the first oil filling hole 221 defined on the lower seat 220, which can realize that the oil can be filed into the atomizer 120 from bottom to top, and the foreign matter or the dander are prevented from entering into the atomizer 120 during the oil is filled.

Referring to FIG. 5, in detail, when the atomizer module 100 is loaded into the atomizer oil filling tool 200, the limit groove 222 controls the position of the atomizer receiving part 110 in the atomizer module 100 in the receiving space 24, that the oil filling opening in the atomizer 120 can be aligned with the first oil filling hole 221 in the lower seat 220.

Further, in order to make the atomizer module 100 easily be installed into the limiting groove 222 and removed from the limiting groove 222, an escape groove 223 is defined in an end of the lower seat 220 adjacent to the receiving space 240, and, the escape groove 223 further communicates with the limiting slot 222.

Furthermore, when the atomizer module 100 is installed into the limiting groove 222, the atomizer receiving part 110 will be tightly attached to a side wall around the limiting groove 222. in order to prevent the atomizer receiving part 110 from being tightly attached to the side wall around the limiting groove 222 which is inconvenient to move the atomizer module 100 from the limiting groove 222, a plurality of buffer slots 224 are arranged on the lower seat 220, and the buffer slots 224 communicate with the limiting slots 222 respectively.

Referring to FIG. 3 and FIG. 5, the atomizer 120 generally has a head, a middle part, and a bottom, the oil filling opening is generally arranged on the head. In some embodiments, when the atomizers 120 are loaded on the atomizer receiving part 110, the atomizer receiving part 110 at least restricts the middle of the atomizer 120. At this time, the limiting groove 222 is provided with a first positioning groove 225, the first oil filling hole 221 is arranged on the first positioning groove 225, and the first positioning groove 225 can limit the head of the atomizer 120. As a result, the oil filling opening of the atomizer 120 is aligned with the first oil filling hole 221.

Specifically, when the atomizer module 100 is installed into the limiting groove 222 with the head of the atomizer 120 facing down, the first positioning groove 225 provided on the limiting groove 222 is aligned with the head of the corresponding atomizer 120. The part is limited so that the oil filling opening provided on the head can be aligned with the first oil filling hole 221 on the lower base 220.

It can be understood that, in some embodiments, the head of the atomizer 120 is a flat structure, and the first positioning groove 225 can play a fool-proof role, so that the oil filling opening can be aligned with the first oil filling hole 221 in the lower base 220.

Figure 6:
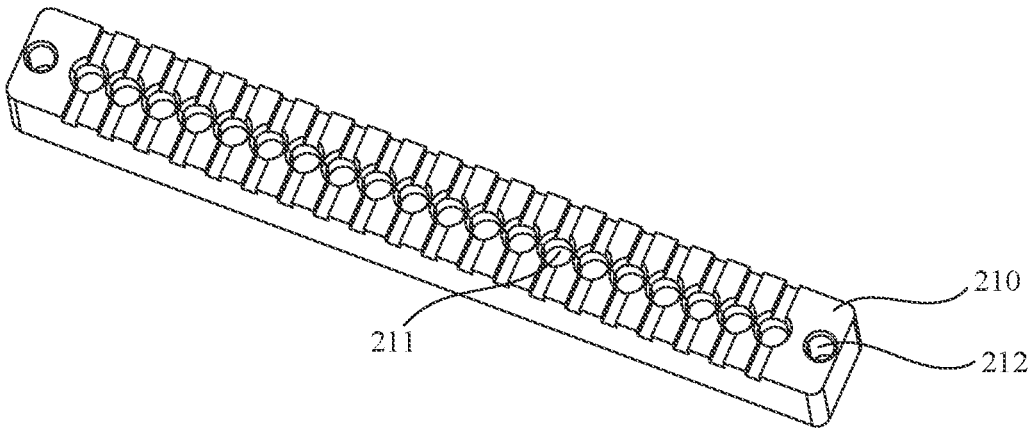
FIG. 6 is a structural diagram of the upper seat in the atomizer oil filling tool provided by the disclosure.

Referring to FIG. 3 and FIG. 6, the atomizer 120 generally has a head, a middle part and a bottom, the oil filling opening is generally defined in the head. In some embodiments, when the atomizer 120 is loaded on the atomizer receiving part 110, the atomizer receiving part 110 at least restricts the middle of the atomizer 120. At this time, a second positioning groove 211 is provided in the upper seat 210, and the second positioning groove 211 can limit the bottom of the atomizer 120, that the positions of the atomizers related to the oil filling tool 200 are further limited, and at the same time, it can prevent the atomizer 120 from shaking during the atomizers 120 are being filled with the oil.

It can be understood that, in some embodiments, the atomizer oil filling equipment fills oil by inserting the oil filling needle 410 into the silica gel sealed on the oil filling opening, which may cause the atomizer 120 to shake, so the first positioning groove 225 is defined to limit the head of the atomizer 120 and the second positioning groove 211 is defined to limit the bottom of the atomizer 120, which can improve the stability of oil filling.

Figure 7:
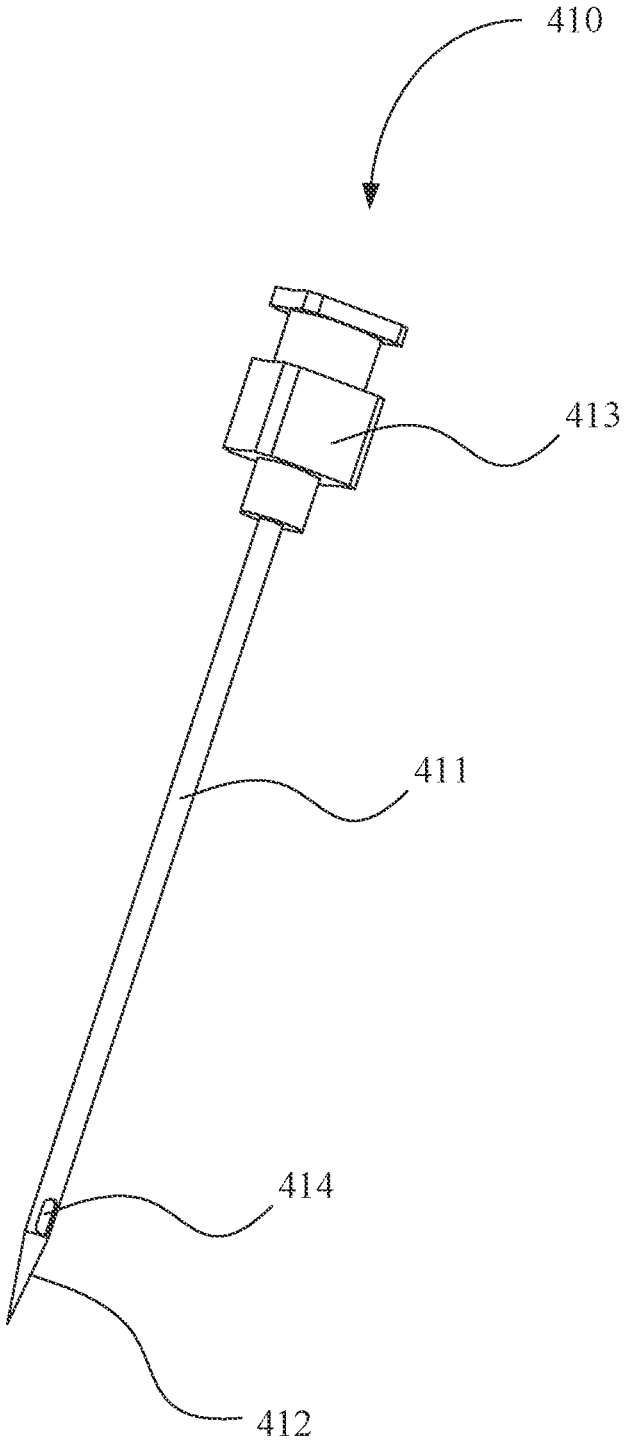
FIG. 7 is the atomizer oil filling tool provided by the disclosure Structural diagram of the oil filling needle in the tool.

Further, referring to FIG. 7, in order to make the oil filling needle 410 easily inserting into the oil filling opening of the atomizer 120, an needling portion 412 is disposed at an end of the oil filling needle 410 away from the oil outlet of the oil filling device. When filling the oil through the oil filling opening, the oil filling needle 410 filling oil into the atomizer 120 by piercing the silica gel sealed on the oil filling opening via the needling part 412. the needling part 412 may be in a tapered shaped.

In addition, the oil filling hole 414 of the oil filling needle 410 can be disposed on the side wall of the oil filling needle 410 near the end of the needling part 412. That is to say, the oil filling needle 410 includes a cylindrical main body 411, and a needling part 412, and a mounting parts 413 respectively arranged at both ends of the main body 411, the mounting part 413 is configured to connect with the oil outlet hole of the oil filling device 400, and the needling part 412 is configured to fill the oil into the atomizer 120, and the oil filling hole 414 is defined in a side wall of the main body 411 near the end of the needling part 412.

It can be understood that, in some embodiments, the oil filling opening of the atomizer 120 is generally opposite to the exhaust hole in the atomizer 120, so if the oil filling hole 414 of the oil filling needle 410 adopts an oblique opening like a tradition way, the oil filling needle 410 may fill the tobacco-liquid into the exhaust hole of the atomizer 120 when filling oil, which may block the exhaust hole.

In addition, the needling part 412 of the oil filling needle 410 pierces through the silica gel sealed on the oil filling opening to fill oil into the atomizer 120, if the oil filling hole 414 of the oil filling needle 410 adopts an oblique opening like a tradition way, an edge of the oil filling hole is also inclined, and a needle wall of the oil filling needle is generally thin, so the edge of the oil filling hole will become very sharp, and it is easy to break a hole in the silicone during the silicone is impaled by the needling par 410, that will make the pollutants in the air easily enter into the atomizer 120 and pollute the tobacco-liquid.

It can be seen that, the filling hole 414 is defined in the side wall of the main body 411 adjacent to the end of the needling part 412 instead of directly defining the oil filling hole 414 in the needling part 412, which can well prevent the pollutants from entering into the atomizer 120 and polluting the tobacco-liquid.

Referring to FIG. 5, in some embodiments, the lower base 220 is provided with several guiding columns 230 detachably mounted to the lower base 220, and the upper seat 210 defines guiding grooves 212 corresponding to each guiding column 230 respectively, when the upper seat 210 is installed on the lower base 220, each guiding columns 230 are located in each guiding groove 212, so as to realize that the upper seat 210 and the lower base 220 are assembled accurately and quickly.

Specifically, the guiding column 230 can be detachably fixed on the lower base 220 by bolts. It can make the guiding column 230 of different heights easily replay according to the atomizer module 100 of different heights, and improves a compatibility of the atomizer oil filling tool 200.

In other embodiments, the upper base 210 is provided with several guiding columns 230 detachably mounted to the upper base 210, and the lower base 220 defines guiding grooves 212 corresponding to guiding columns 230 respectively, the upper seat 210 is installed on the lower base 220, each guiding column 230 is located in each guiding groove 212.

Figure 8:
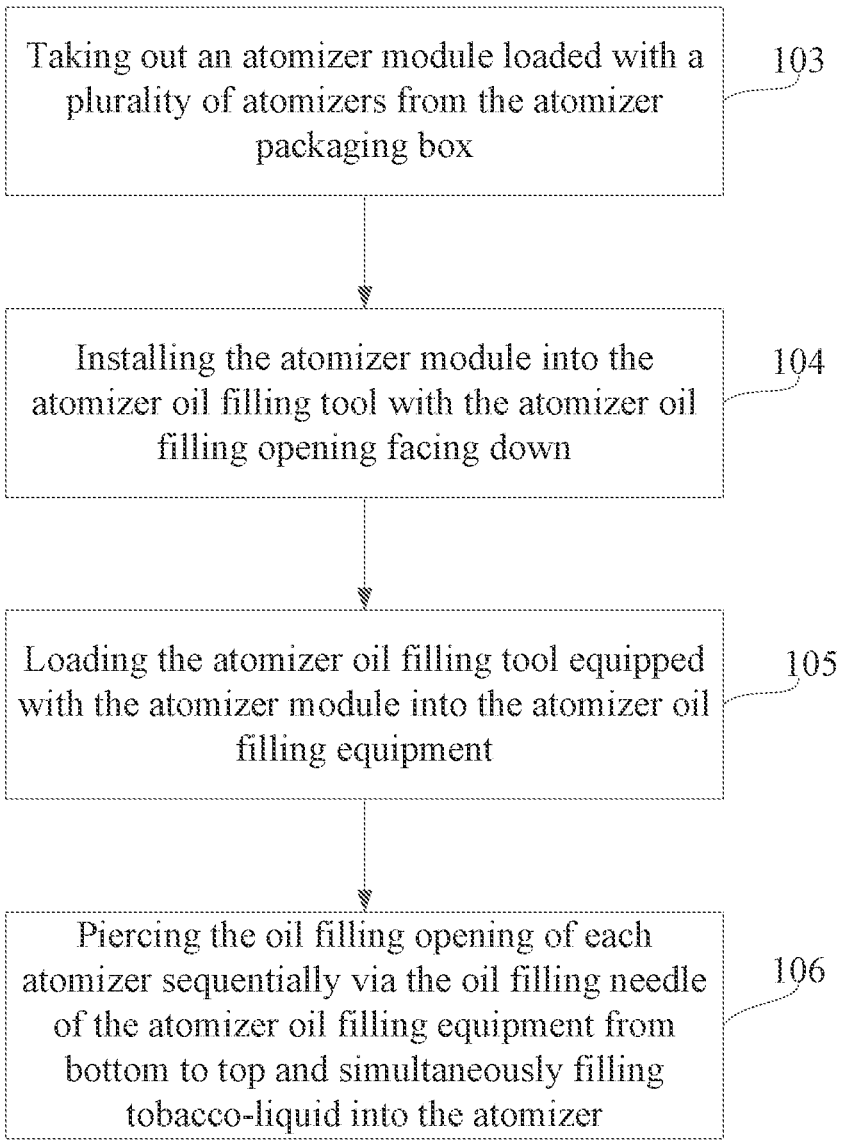
FIG. 8 is the first block flow diagram of the oil filling method provided by the disclosure.

Referring to FIG. 8, an oil filling method is provided and the oil filling method, includes follow steps.

At step 103, taking out the atomizer module loaded with a plurality of atomizers from the atomizer packaging box.

At step 104, installing the atomizer module into the atomizer oil filling tool with the atomizer oil filling opening facing down.

At step 105, loading the atomizer oil filling tool equipped with the atomizer module into the atomizer oil filling equipment.

At step 106, piercing the oil filling opening of each atomizer sequentially via the oil filling needle of the atomizer oil filling equipment from bottom to top and simultaneously filling tobacco-liquid into the atomizer.

That is to say, in the oil filling method provided, the atomizer module loaded with the plurality of the atomizers is loaded into the atomizer oil filling tool, and then the atomizer oil filling tool is loaded into the atomizer oil filling equipment. In addition, the oil filling opening of each atomizer is facing down, and then the oil filling needle of the atomizer oil filling equipment. fill oil into the atomizer through the oil filling opening. This method can ensure that pollutants will not enter into the atomizer during the oil filling process and ensure the cleanliness of the atomizer.

Figure 9:
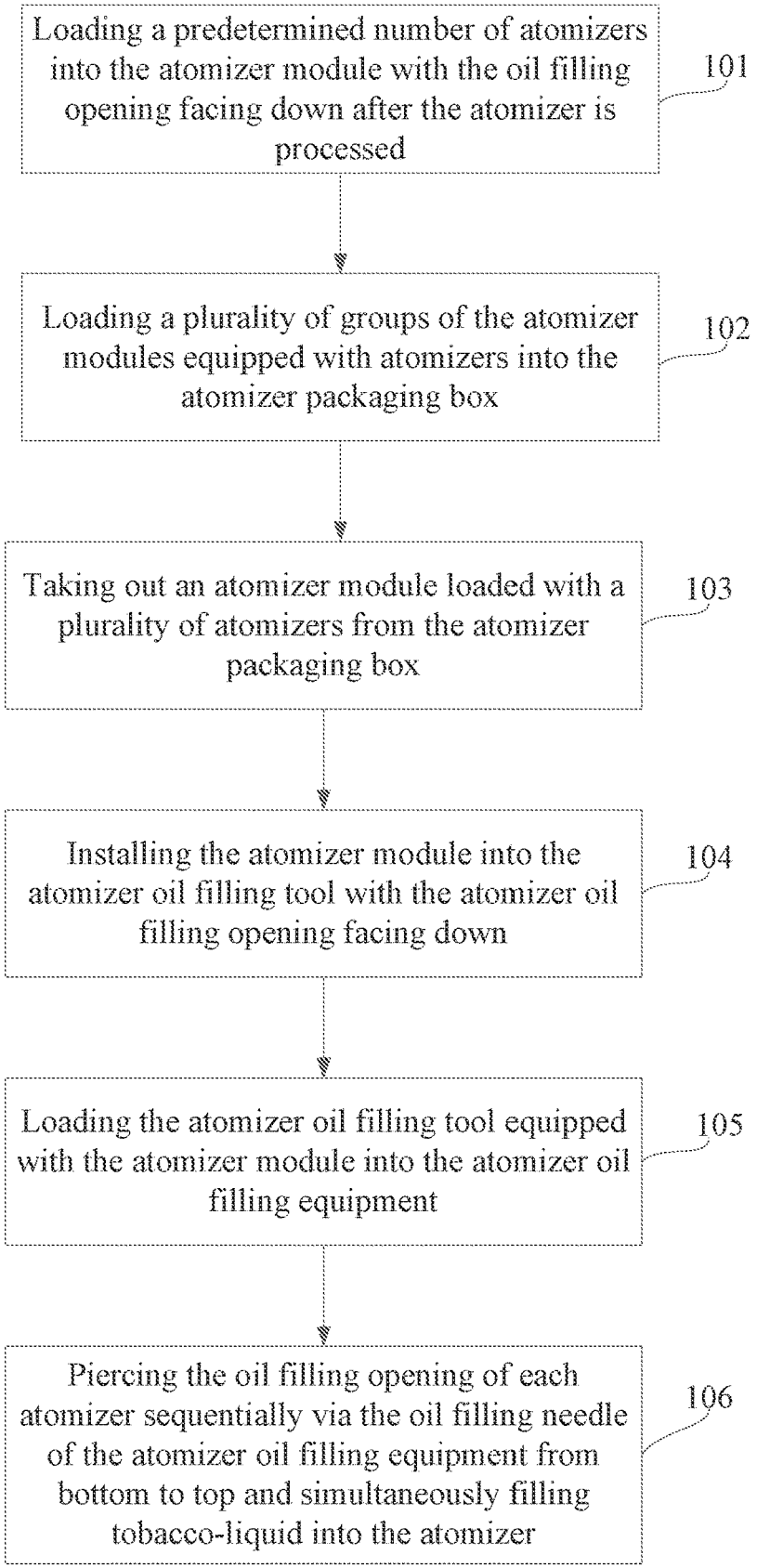
FIG. 9 is the second flow block diagram of the oil filling method provided by the disclosure.

Further, referring to FIG. 9, before step 102, the oil filling method also includes following steps.

At step 101, after the atomizer is processed, loading a predetermined number of atomizers into the atomizer module with the oil filling opening facing down.

For example, twenty atomizers can be packed into the one atomizer module as a group. That is to say, there are twenty atomizers to be filled in one atomizer module.

At step 102, loading a plurality of groups of atomizer modules equipped with atomizers into the atomizer packaging box.

For example, five groups of atomizer modules loaded with atomizers can be packed into the atomizer box. That is to say, there are five groups of atomizer modules in one atomizer box, that is, one hundred atomizers are divided into 5 groups of atomizer modules. This method can realize that the atomizers can be filled with oil in modularization, and it will improves efficiency of checking defective rate of the atomizers.

The above are only preferred embodiments of the disclosure, and are not intended to limit the disclosure. Any modifications, equivalent replacements and improvements made within the spirit and principles of some inventions should be included in the protection scope of some inventions inside.

The invention claimed is:

1. An oil filling method, comprising:

taking out an atomizer module loaded with a plurality of atomizers from an atomizer packaging box;

installing the atomizer module into an atomizer oil filling tool an atomizer oil filling opening facing down;

loading the atomizer oil filling tool equipped with the atomizer module into an atomizer oil filling equipment; and piercing the oil filling opening of each atomizer sequentially via an oil filling needle of the atomizer oil filling equipment from bottom to top and simultaneously filling tobacco-liquid into the atomizer.

2. The oil filling method according to claim 1, wherein before taking out the atomizer module loaded with a plurality of atomizers from the atomizer packaging box, it also includes:

loading a predetermined number of atomizers into the atomizer module with the oil filling opening facing down after the atomizer is processed; and loading a plurality of groups of the atomizer modules equipped with atomizers into the atomizer packaging box.

* * * * *